US010203099B1

(12) United States Patent
McCann

(10) Patent No.: US 10,203,099 B1
(45) Date of Patent: Feb. 12, 2019

(54) SHADE FOR A HEADLAMP

(71) Applicant: Jonathan McCann, Victor, NY (US)

(72) Inventor: Jonathan McCann, Victor, NY (US)

( * ) Notice: Subject to any disclaimer, the term of this patent is extended or adjusted under 35 U.S.C. 154(b) by 0 days.

(21) Appl. No.: 15/714,437

(22) Filed: Sep. 25, 2017

(51) Int. Cl.

| | |
|---|---|
| ***F21V 21/084*** | (2006.01) |
| ***F21V 9/08*** | (2018.01) |
| ***F21V 3/06*** | (2018.01) |
| ***F21V 1/18*** | (2006.01) |
| ***F21V 1/22*** | (2006.01) |

(52) U.S. Cl.
CPC ..... *F21V 21/084* (2013.01); *F21V 1/18* (2013.01); *F21V 1/22* (2013.01); *F21V 3/062* (2018.02); *F21V 9/083* (2013.01)

(58) Field of Classification Search
CPC ..... F21V 21/084
USPC ..... 362/105
See application file for complete search history.

(56) References Cited

U.S. PATENT DOCUMENTS

| | | | |
|---|---|---|---|
| 2,326,004 | A | 8/1943 | Barrett |
| 3,418,651 | A | 12/1968 | Jacobson |
| 5,311,409 | A | 5/1994 | King |
| 8,215,803 | B2 | 7/2012 | Singer |
| 8,678,601 | B2 | 3/2014 | Morris et al. |
| 9,079,239 | B2 | 7/2015 | Kojima et al. |
| 2006/0049733 | A1 | 3/2006 | Brock |
| 2006/0146513 | A1 | 7/2006 | Liu |
| 2008/0030138 | A1 | 2/2008 | Turner |
| 2010/0315821 | A1 | 12/2010 | Weber et al. |
| 2012/0320606 | A1 | 12/2012 | Vossoughi |
| 2016/0091184 | A1* | 3/2016 | Ng ..... A45F 3/20 362/101 |

FOREIGN PATENT DOCUMENTS

| | | |
|---|---|---|
| DE | 202004016592 | 3/2005 |
| WO | 02088596 | 11/2002 |

OTHER PUBLICATIONS

Epak Electronics Ltd., UV226 PL Lamp UV Filter Sleeves, http://www.epakelectronics.com/ uv_filter_materials_sleeves_htm.
Ehobby Asia, Surefire Minimus TM Variable-Output-LED Headlamp, http://shop.ehobbyasia.com/surefire-minimustm-variable-output-led-headlamp.html#.Wbk2v9GQzmE.
ipmagazin.bg, BL-6855—CREE Q3 LED rechargeable headlamp setting focus with 3 filter, http://ipmagazin.bg/en/p/2966/bl-6855---cree-q3-led-rechargeable-headlamp-setting-focus-with-3-filter-.
Rei Co-Op—Mammut TR1 2-in-1 Headlamp/Lantern Combo, https://www.rei.com/product/799383/mammut-tr1-2-in-1-headlamplantern-combo.

* cited by examiner

*Primary Examiner* — Sean P Gramling
(74) *Attorney, Agent, or Firm* — Woods Oviatt Gilman LLP; Katherine H. McGuire, Esq.

(57) ABSTRACT

A shade for removable attachment to a headlamp assembly having a headlamp connected to a head-strap where the shade is formed from first and second flexible, translucent wall panels which may lay flat against each other when not in use. The shade includes notches formed in each wall panel to which the segments of the head-strap located on either side of the headlamp may be removably connected. The headlamp assembly and shade when connected together may be suspended from a fixed point or placed upon a flat surface thereby creating a hands-free lantern.

10 Claims, 5 Drawing Sheets

SHADE FOR A HEADLAMP

BACKGROUND OF THE INVENTION

The present invention relates to a removable shade for a headlamp which incorporates a strap for attaching the headlamp to the user's head about the forehead. Headlamp assemblies are commonly used for hiking and camping but may be utilized for any activity where a light source is required. The headlamp assembly frees the user's hands and is therefore typically more desirable than a flashlight or hand held lantern.

It is sometimes desired to adjust the brightness of the headlamp, for example, lowered, filtered and/or otherwise provided in a color and intensity that is different that the lamp source itself. A removable shade which a user may attach to the headlamp assembly to create the desired lighting effect is therefore desirable. Such removable light shades may furthermore be configured to allow the user to sit the headlamp assembly upon a flat surface or hang it from a fixed point (e.g., a hook), in either case thereby converting the headlamp assembly into a lantern. While various headlamp assembly shades have been proposed, most have a non-flexible housing and are not convenient to carry as an accessory, especially when camping or hiking when packing space, and hence packing load, is desired to be kept to a minimum.

SUMMARY OF THE INVENTION

The present invention addresses the above needs by providing in a first aspect a removable shade for a headlamp assembly having a headlamp attached to a head strap. The removable shade is preferably made from a light diffusing, sturdy yet flexible material such as polypropylene, for example. The shade is configured to include first and second wall panels which may lay over each other in a contacting, thin, flat configuration when not attached to a headlamp. As such, the shade is very easily packed into the user's carry bag or clothing pockets and does not take up much room.

In one embodiment, the removable shade is rectangular shaped with the first and second panels being closed along three sides thereof. The fourth side is open and provides an opening wherethrough the headlamp may be removably inserted in between the first and second panels. The fourth side further preferably includes first and second notches cut or otherwise formed in the free edges of the first and second panels, respectively. In an embodiment, the notches are "T" shaped and allow first and second headband segments, which are adjacent to and located on either side of the headlamp, to be removably inserted into a respective first and second notch thereby removably securing the headlamp assembly to the shade.

In a first embodiment, the present invention provides a shade for removable attachment to a headlamp assembly comprising a headlamp connected to a head-strap where the shade is formed from first and second flexible, translucent wall panels which may lay flat against each other when not in use. The shade includes notches formed in each wall panel to which the segments of head-strap located on either side of the headlamp may be removably connected.

In another aspect, the present invention provides a method of converting a headlamp assembly having a headlamp attached to a head-strap into a shaded lantern, wherein the method comprises the steps of providing a shade having first and second flexible, translucent wall panels which may lay flat against each other when not in use, the panels having an opening leading to an interior defined by the first and second panels, the opening defined by first and second free side edges each including a notch; removably inserting first and second segments of the head-strap which are located on either side of the headlamp into the first and second notches; and inserting the headlamp into the interior of the shade between the first and second wall panels. If desired, the headlamp may be inserted into the interior of the shade first and thereafter the head-strap segments attached to the respective notches.

In this attached condition, the first and second panels are flexed outwardly and held in this position by the headlamp to form outwardly curved, first and second wall panels. The headlamp assembly with shade may thereafter be suspended from a fixed point by the head-strap, or placed upon a flat surface which is possible since the panel wall free edges in the attached condition are spaced from each other and form a stable platform for the shade.

Additional objects, advantages and novel aspects of the present invention will be set forth in part in the description which follows, and will in part become apparent to those in the practice of the invention, when considered with the attached figures.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein:

FIGS. 1A-D are front elevation, top plan, side elevation and perspective views of an embodiment of headlamp assembly shade according to the invention, respectively;

DETAILED DESCRIPTION OF A PREFERRED EMBODIMENT

Figure 1B:
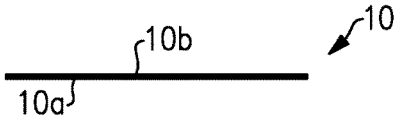
Figure 1A:
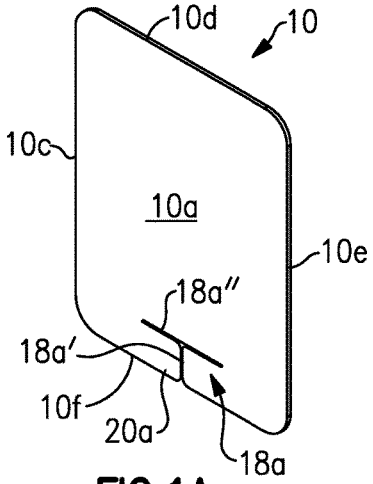
Figure 1C:
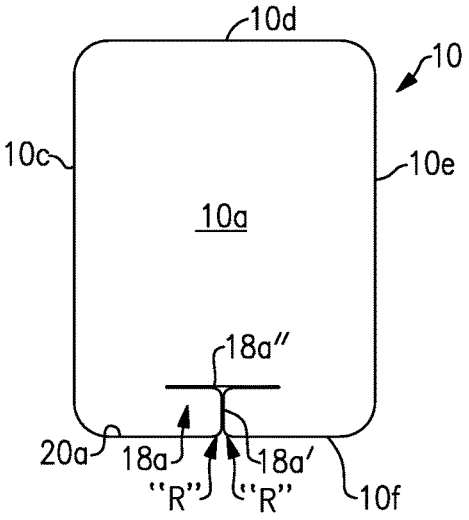
Figure 1D:
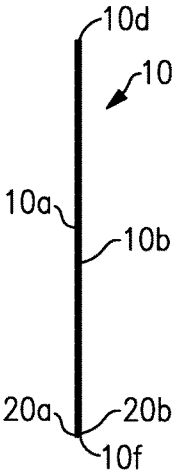

The present invention provides in a first aspect a removable shade 10 for a headlamp assembly 12 having a headlamp 14 attached to a head strap 16. The removable shade 10 is preferably made from a light diffusing, sturdy yet flexible material such as polypropylene, for example. The shade 10 is configured to include first and second wall panels 10*a* and 10*b* which are interconnected along at least one edge and may lay over each other in a contacting, thin, flat configuration when not attached to a headlamp 14 (see FIGS. 1A-D). As such, the shade 10 is very easily packed into the user's duffle bag, backpack or clothing pockets (not shown), and as such does not take up much room or create any appreciable added weight.

In an embodiment, the removable shade 10 may be square or rectangular shaped with the first and second panels 10*a*, 10*b* being closed along three sides 10*c*, 10*d* and 10*e* thereof. The fourth side 10*f* is open and provides an opening "O" wherethrough the headlamp 14 may be removably inserted in between the first and second panels 10*a*, 10*b*. While a four-sided configuration is shown and described herein, it is understood that other configurations are possible and within the scope of the invention including, for example, polygonal, arcuate and any combinations thereof.

The panel edges which are not interconnected (in this embodiment, fourth side 10*f*) further preferably includes first and second notches 18*a*, 18*b* cut or otherwise formed in the first and second free edges 20*a*, 20*b* of the first and second panels 10*a*, 10*b*, respectively. In an embodiment, the notches are "T" shaped with a first linear slit 18*a*', 18*b*' extending from and perpendicular to respective free edge 20*a*, 20*b*, and a second linear slit 18*a*", 18*b*" extending perpendicular to respective first linear slits 18*a*', 18*b*'. The second linear slits 18*a*", 18*b*" extend spaced and parallel to respective free edge 20*a*, 20*b* to form a "T" with first linear slits 18*a*', 18*b*'. This "T" configuration allows first and second headband segments 16*a*, 16*b*, which are adjacent to and located on either side of the headlamp 14, to be manually maneuvered into a respective first and second linear slits 18*a*', 18*b*' and thereafter manually maneuvered into respective second linear slits 18*a*", 18*b*" wherein the head-strap segments 16*a*, 16*b* reside while headlamp assembly 14 is attached to shade 10. In an embodiment, the corners of first and second slits 18*a*', 20*a*' may have rounded corners "R" adjacent free edges panel 20*a*, 20*b* to facilitate the insertion of head-strap segments 16*a*, 16*b* therein, respectively. Withdrawal of head-strap segments 16*a*, 16*b* from respective notches 18*a*, 20*b* is easily performed by performing the same attachment manual maneuver described above in reverse. Although a "T" notch configuration is shown and described herein, it is understood that notches 18*a*, 18*b* may be formed in other configurations (linear and or curved) so long as they are adapted to removably connect shade 10 to head-strap segments 16*a*, 16*b*.

In another aspect, the present invention provides a method of converting a headlamp assembly having a headlamp attached to a head-strap into a shaded lantern, wherein the method comprises the steps of providing a shade 10 having first and second, flexible, translucent wall panels 10*a*, 10*b*, respectively, which may lay flat against each other when not in use, such as seen in FIGS. 1A-D. The panels 10*a*, 10*b* have an opening "0" leading to an interior "I" defined by the first and second panels, the opening defined by first and second free side edges 20*a*, 20*b* each including a notch 18*a*, 18*b*; removably inserting first and second segments 16*a*, 16*b* of the head-strap 16 which are located on either side of the headlamp 14 into the first and second notches 18*a*, 18*b*; and inserting the headlamp 14 into the interior "I" of the shade 10 between the first and second wall panels 10*a*, 10*b*. If desired, the headlamp 14 may be inserted into the interior "I" of the shade 10 first and thereafter the head-strap segments 16*a*, 16*b* may be attached to the respective notches 18*a*, 18*b*.

Figure 2A:
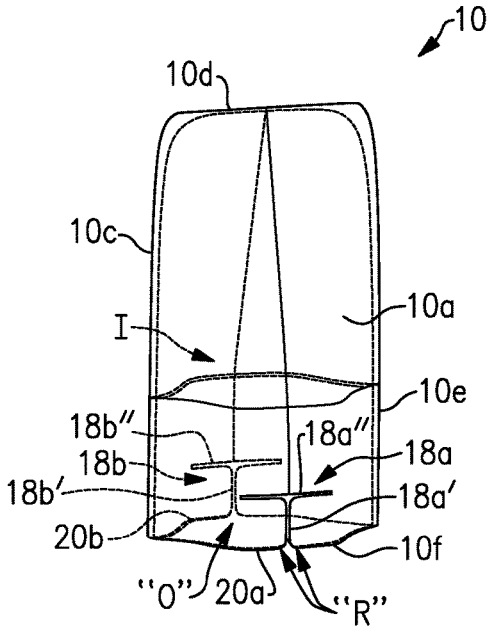
FIG. 2A is a front perspective view of the shade in the flexed condition and showing the hidden back panel wall in dashed lines.
Figure 2B:
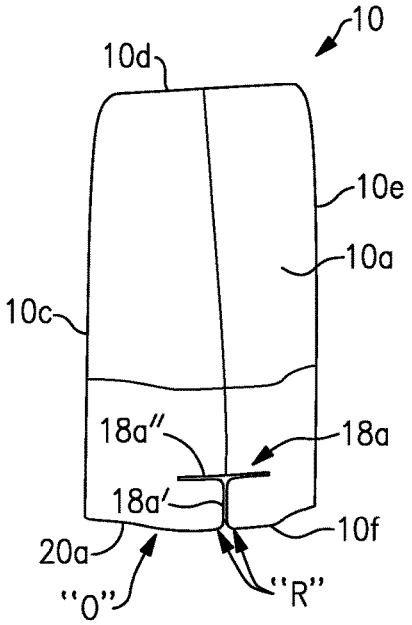
FIG. 2B is the view of FIG. 2A without showing the hidden back panel wall.
Figure 3A:
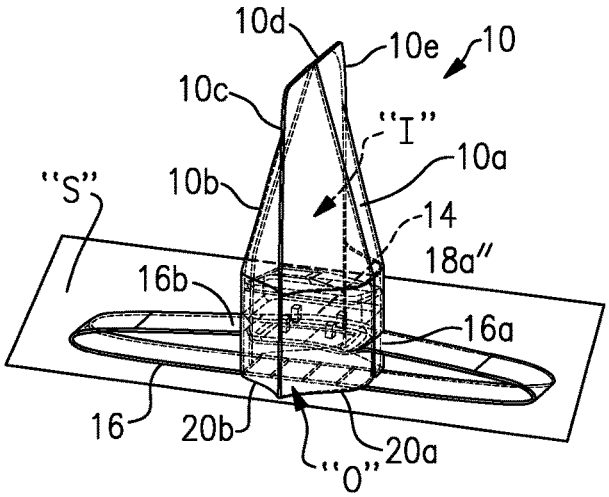
FIG. 3A is a perspective view showing the shade of FIGS. 1 and 2 removably attached to a headlamp assembly and positioned on a flat surface with the otherwise hidden shade parts and headlamp shown in dashed lines.
Figure 3B:
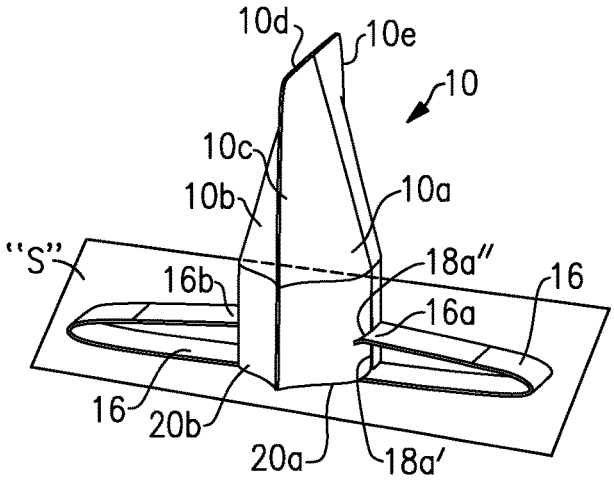
FIG. 3B is the view of FIG. 3A without showing the hidden features of the shade or headlamp.
Figure 4A:
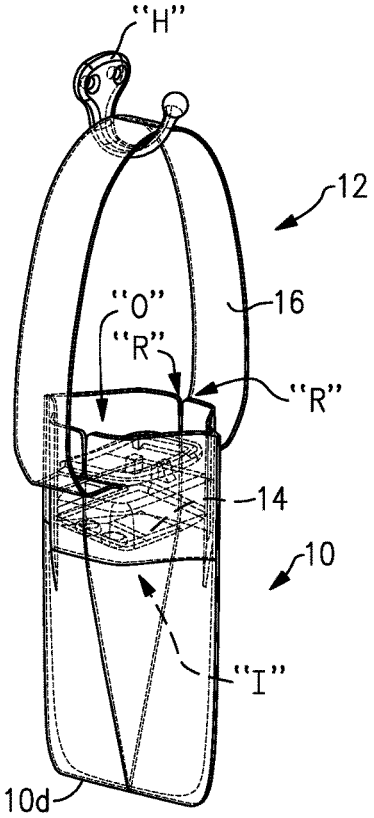
FIG. 4A is a perspective view showing the shade of FIGS. 1 and 2 removably attached to a headlamp assembly and suspended from a hook with the otherwise hidden shade parts and headlamp shown in dashed lines.
Figure 4B:
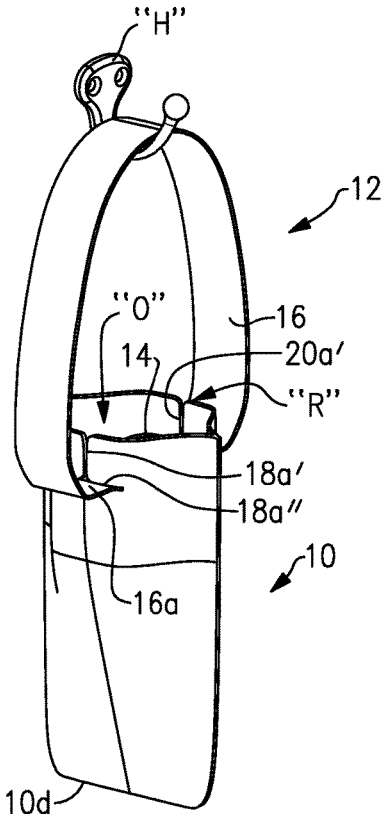
FIG. 4B is the view of FIG. 4A without showing the hidden features of the shade or headlamp or hook.
Figure 5A:
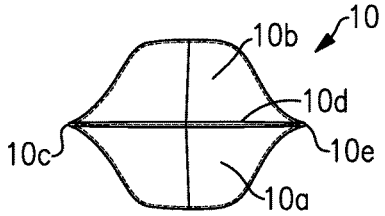
FIGS. 5A-C are front and side elevation and top plan view of the shade shown in the expanded condition.
Figure 5B:
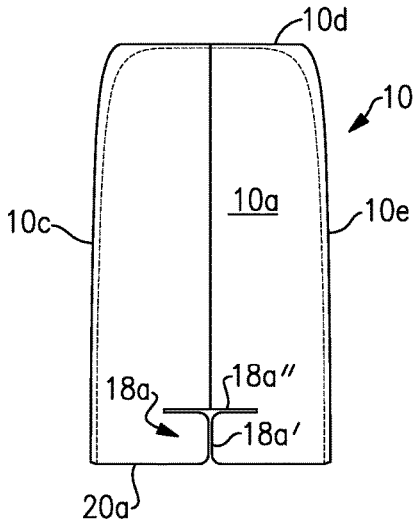
Figure 5C:
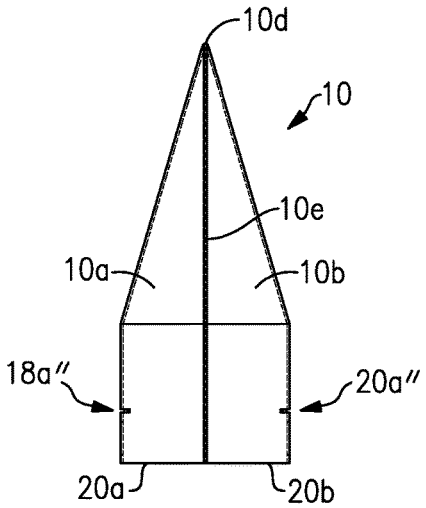

In this attached condition, the first and second panels 10*a*, 10*b* are flexed outwardly and held in this position by the headlamp 14 to form outwardly curved, first and second wall panels 10*a*, 10*b* as seen in FIGS. 2A-5C. The headlamp assembly 12 with shade 10 may thereafter be suspended from a fixed point such as a hook "H" seen in FIGS. 4A, 4B by the head-strap 16, or placed upon a flat surface "S" as seen in FIGS. 3A, 3B which is possible since the panel wall free edges 20*a*, 20*b* in the attached condition are spaced from each other and form a stable platform for the shade 10.

it will thus be appreciated that the present invention provides a shade for a headlamp assembly which allows the user to create a hands-free lantern. The shade is extremely light-weight and takes up a minimum of space when not in use such that it is easily packed and carried with other belongings (e.g., in a backpack or pocket). The shade may be provided in multiple colors so that the user may choose the desired lighting effect. The translucency of the shade panels may also be varied as desired by selecting the appropriate materials and thicknesses for the panels.

While this method and apparatus has been shown and described with reference to certain preferred embodiments thereof, it will be understood by those skilled in the art that various changes in form and details may be made therein without departing from the spirit and scope of the invention as described.

What is claimed is:

1. A removable shade for removable attachment to a headlamp assembly having a headlamp attached to a head strap, the head-strap having first and second segments located on either side of the headlamp, said shade comprising:

a) first and second, flexible, translucent panels laying in contacting, covering relation to each other when said shade is unattached to a headlamp assembly, said first and second panels interconnected to each other along an edge and first and second unconnected, free edges of said first and second panels defining an opening leading to an interior of said shade located between said first and second panels, said interior adapted to removably receive via said opening a headlamp of a headlamp assembly;

b) first and second notches formed in said first and second free edges of said first and second panels, respectively, said first and second notches adapted for removable connection of first and second segments of the head-strap to said shade, wherein said first and second notches each include first and second slits extending perpendicular to each other to form a "T" with said second slits extending spaced and parallel to said first and second free edges of said first and second panels, respectively.

2. The removable shade of claim 1 wherein said first slits each have rounded corners located adjacent said first and second free edges, respectively.

3. The removable shade of claim 2 wherein said shade is rectangular shaped defined by first, second, third and fourth edges with said first, second and third edges being closed and said fourth edge being open.

4. The removable shade of claim 1 wherein said first and second panels are formed of polypropylene.

5. The removable shade of claim 1 wherein said shade is colored.

6. A method of converting a headlamp assembly to a shaded hands-free lantern, said headlamp assembly having a headlamp attached to a head strap, the head-strap having first and second segments located on either side of the headlamp, said method comprising the steps of:

a) providing first and second, flexible, translucent panels laying in contacting, covering relation to each other when said shade is unattached to a headlamp assembly, said first and second panels interconnected to each other along an edge and first and second unconnected, free edges of said first and second panels defining an opening leading to an interior of said shade located between said first and second panels, said interior adapted to removably receive via said opening a headlamp of a headlamp assembly;

b) forming first and second notches formed in said first and second free edges of said first and second panels, respectively, said first and second notches adapted for removable connection of first and second segments of the head-strap to said shade, wherein said first and second notches each include first and second slits extending perpendicular to each other to form a "T" with said second slits extending spaced and parallel to said first and second free edges of said first and second panels, respectively;

c) removably attaching said shade to a headlamp assembly by manually maneuvering said first and second strap segments into said first and second notches and inserting said headlamp into said interior.

7. The method of claim 6 wherein said first slits each have rounded corners located adjacent said first and second free edges, respectively.

8. The method of claim 7 wherein said shade is rectangular shaped defined by first, second, third and fourth edges with said first, second and third edges being closed and said fourth edge being open.

9. The method of claim 6 wherein said first and second panels are made of polypropylene.

10. The method of claim 6 wherein said first and second panels are colored.

* * * * *